US005345141A

United States Patent [19]

Moyer et al.

[11] Patent Number: 5,345,141

[45] Date of Patent: Sep. 6, 1994

[54] SINGLE SUBSTRATE, VACUUM FLUORESCENT DISPLAY

[75] Inventors: Curtis D. Moyer, Phoenix; John Song, Tempe; James E. Jaskie, Scottsdale, all of Ariz.

[73] Assignee: Motorola, Inc., Schaumburg, Ill.

[21] Appl. No.: 45,407

[22] Filed: Mar. 29, 1993

[51] Int. Cl.[5] ..... H01J 1/62

[52] U.S. Cl. ..... 313/495; 313/496

[58] Field of Search ..... 313/495, 169.1, 169.3, 313/496, 309, 505, 495, 496, 309, 169.1, 169.3

[56] References Cited

U.S. PATENT DOCUMENTS

| | | | |
|---|---|---|---|
| 5,049,866 | 9/1991 | Miyajima | 340/765 |
| 5,128,006 | 7/1992 | Mitchell et al. | 204/181.5 |
| 5,189,341 | 2/1993 | Itoh et al. | 313/309 |

OTHER PUBLICATIONS

Ziger et al., "Compressed Fluid Technology: Application to RIE-Developed Resist", AIChE Journal, Oct. 1987, vol. 33, No. 10.

Ziger, "In situ Capacitance Studies of Thin Polymer Films During Compressed Fluid Extraction", J. Mater. Res., vol. 2, No. 6 Nov./Dec. 1987.

Shinagawa, "Resist Drying Method", JP 1986, JP-222560.

"Vacuum fluorescent displays (VF Ds)" Electronic Display Devices, 1984, pp. 219-272.

*Primary Examiner*—Ulysses Weldon
*Assistant Examiner*—Doon Chow
*Attorney, Agent, or Firm*—Eugene A. Parsons

[57] ABSTRACT

A single substrate, vacuum fluorescent display including a first layer of electrically conductive material positioned on a supporting substrate and a light emitting layer including phosphor positioned on the first layer. A second layer of electrically conductive material is supported on the substrate and electrically insulated from the first layer. An electron emitting layer of low work function material is positioned on the second layer and further positioned so that emitted electrons strike the light emitting layer. Since both the electron emitting and the light emitting layers are supported on the substrate, an encapsulating window is simple and easy to construct. Integrated drivers are optionally formed in the supporting substrate.

18 Claims, 3 Drawing Sheets

SINGLE SUBSTRATE, VACUUM FLUORESCENT DISPLAY

RELATED APPLICATION

A copending U.S. patent application entitled "Cathodoluminescent Display Employing Diamond Material Electron Source" was filed on Sept. 2, 1992 and given Ser. No. 07/938,744. The '744 patent application and the present patent application are both assigned to the same assignee.

FIELD OF THE INVENTION

The present invention pertains to vacuum fluorescent displays and more particularly to a vacuum fluorescent display with simplified construction.

BACKGROUND OF THE INVENTION

Vacuum fluorescent displays are currently used as the display device in many common home digital clocks and the like. In addition to the common blue-green clock display, a variety of colored displays and high resolution graphic displays are offered as products.

The basic operation of a vacuum fluorescent display involves the emission of electrons from a low work function thermionic filament cathode, the acceleration of the thermionically emitted electrons by an electric field and stimulation of a phosphor anode by the impacting electrons resulting in cathodoluminescent light generation in the phosphor.

In the vacuum fluorescent display, the filament cathode to phosphor anode voltage determines whether the phosphor emits light and the intensity of the emitted light. The vacuum fluorescent display is similar to the common cathode ray tube found in televisions and monitors, except that the cathode ray tube uses electromagnetics to direct electrons to the addressed pixel while the vacuum fluorescent display requires that illuminated pixels be individually biased. Some vacuum fluorescent displays utilize mesh grids to "gate" the electron flow to cathode areas, thereby, the mesh grid may be used to select which pixels to light. By using an array of filament cathodes and biasing individual pixels in combination with grid structures, a matrix addressed flat panel display results. In contrast, the cathode ray tube requires a large depth to allow for electron beam deflection.

In vacuum fluorescent displays, typical filament cathodes are tungsten wire coated with barium and strontium compounds that allow sufficient electron emission at approximately 10 volts bias at 600° C. filament temperature. The common phosphor used at this low bias voltage is ZnO:Zn, which gives a blue-green cathodoluminescent light emission.

A common $\frac{3}{4}''$ by 3" clock module draws approximately 300 mW to bias the filament (for heating). Further, because of the hot filaments the spacing between the hot filaments and the phosphor is substantial, currently the thickness is approximately $\frac{1}{4}''$.

SUMMARY OF THE INVENTION

It is a purpose of the present invention to provide a new and improved single substrate, vacuum fluorescent display.

It is a further object of the present invention to provide a new and improved single substrate, vacuum fluorescent display which is relatively easy and inexpensive to manufacture.

The above problems and others are solved and the above purposes and others are realized in single substrate, vacuum fluorescent display including a supporting substrate, a first layer of electrically conductive material positioned on the substrate, a light emitting layer including phosphor positioned on the first layer, a second layer of electrically conductive material supported on the substrate and electrically insulated from the first layer, and an electron emitting layer of low work function material positioned on the second layer and further positioned so that emitted electrons strike the light emitting layer.

The above problems and others are solved and the above purposes and others are further realized in a method of manufacturing a single substrate fluorescent display including the steps of providing a substrate with a planar upper surface, forming conductive rows along the surface of the substrate, depositing light emitting material including phosphor on the conductive rows so as to define a plurality of pixels, depositing a layer of dielectric material on a centrally located portion of each of the pixels with portions of light emitting material at each pixel extending outwardly therefrom, positioning columns of metal on the dielectric layers so as to define junctures with the rows of metal at each pixel, and depositing an electron emitting layer of low work function material on the columns of metal at each pixel, the low work function layer being positioned so that electrons emitted by the emitting layer at each pixel strike the outwardly extending portions of light emitting material adjacent thereto.

BRIEF DESCRIPTION OF THE DRAWINGS

Referring to the drawings.

DESCRIPTION OF THE PREFERRED EMBODIMENTS

Figure 1:
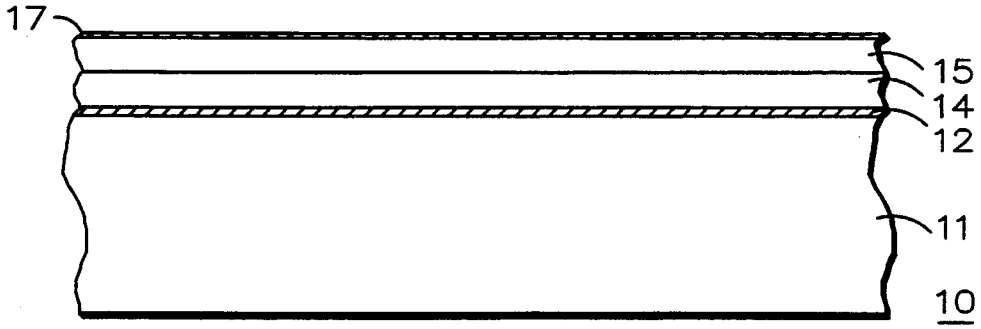
FIGS. 1–4 illustrate various steps in the construction of an embodiment of a vacuum fluorescent pixel in accordance with the present invention.

Various steps in the construction of one embodiment of a vacuum fluorescent pixel 10 in accordance with the present invention are illustrated in FIGS. 1–4. Referring specifically to FIG. 1, a substrate 11 is provided, which is formed of, for example, silicon or saphire. Substrate 11 is provided with a substantially planar upper surface. A layer 12 of conductive material is formed along the upper surface of substrate 11, by some convenient method, such as the deposition of metal by CVD, PECVD, etc. or doping of the substrate. In general. it is believed to be more convenient (and a better conductor) to deposit a layer of metal on the surface of substrate 11, which layer is on the order of 0.5 to 1.0 micrometers thick.

A layer 14 of light emitting material including phosphor is positioned on substrate 11 so as to overlie layer 12. Layer 14 may include any of the well known light emitting materials, including the commonly available material ZnO:Zn. In this embodiment layer 14 is approximately one micrometer thick and covers the extent of pixel 10, for convenience in deposition.

A layer 15 of dielectric material is deposited on the upper surface of layer 14 so as to be substantially coextensive therewith. A layer 17 of conductive material, such as metal, is deposited on the upper surface of layer 15. Layers 12 and 17 are generally, for convenience, formed utilizing a similar process and are generally a similar metal with similar thicknesses.

A layer 18 of an electron emitting low work function material is deposited on layer 17. Layer 18 includes any material that easily emits electrons with a relatively low bias voltage, such as diamond, various metals such as aluminum or gallium with cesium or cesium and oxygen activated surfaces, etc. Diamond is preferred for layer 18 because of the tendency for most other materials to deteriorate with use. Layer 18 may include diamond grit, CVD diamond, a diamond film (see U.S. Pat. No. 5,128,006, entitled "Deposition of Diamond films on Semiconductor Substrates", issued Jul. 7, 1992, for an example of diamond films.), diamond-like carbon, other deposited diamond, a metal based field emission structure, or other suitable electron source.

Figure 2:
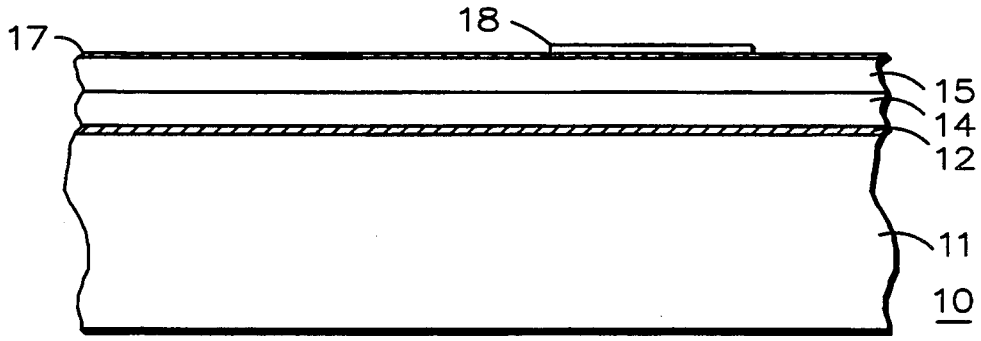
Figure 3:
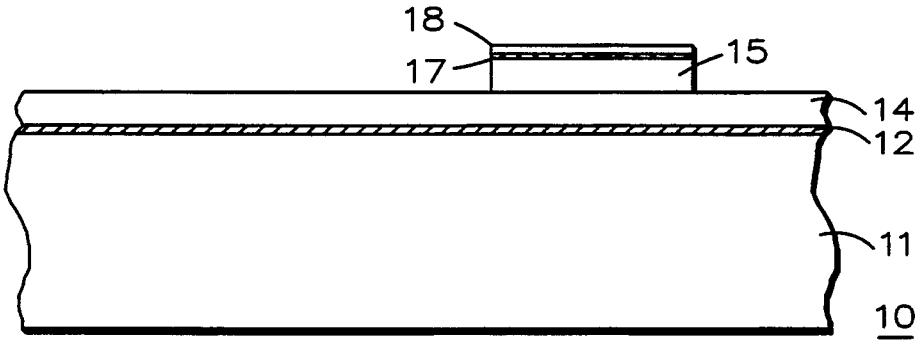

Layer 18 is patterned to be positioned generally on a centrally located portion of light emitting layer 14, as illustrated in FIG. 2. Layer 18 is then utilized as a mask and layers 17 and 15 are etched to uncover light emitting layer 14, as illustrated in FIG. 3. By generally centrally locating layer 18, relative to layer 14, and then utilizing it as an etch mask, when light emitting layer 14 is uncovered by the etching step (or steps), portions of light emitting layer 14 extend outwardly from electron emitting layer 18. Layer 17 of conducting material is insulated from layer 14 by layer 15 of dielectric material.

Figure 4:
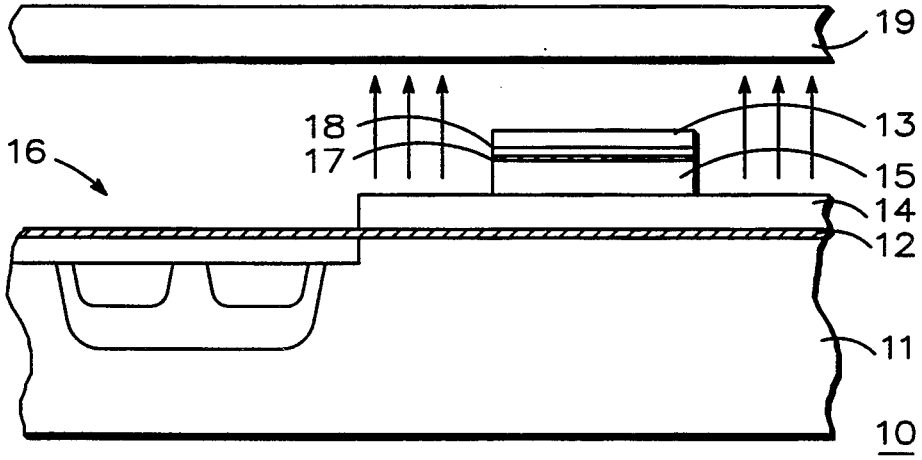

Referring to FIG. 4, layer 12 of conducting material is an electrical connection, in this embodiment a positive electrode, for pixel 10. Layer 17 of conducting material is an electrical connection, in this embodiment a negative electrode, for pixel 10. Applying a voltage of sufficient magnitude between layer 12 and layer 17 causes layer 18 to emit electrons (represented by broken lines in FIG. 4), which emitted electrons strike layer 14 and excite the light emitting material of layer 14 and produces light (represented by the wavy arrows of FIG. 4). Because the majority of electrons are emitted from the edges of layer 18 and are emitted generally horizontally outwardly, layer 14 must be deposited in a position to receive these emitted electrons, or in a generally outwardly extending relationship to layer 18. We have found that substantial electron emission occurs from diamond, for example, at approximately 8–10 volts/micrometer. In this embodiment, the spacing between layer 14 of light emitting material and layer 18 of electron emitting material is set by the thickness of layer 15 of dielectric material. Typically the thickness of layer 15 is easily and accurately controlled during deposition (CVD, PECVD, etc.). Generally, pixel 10 is constructed with approximately one micrometers between layers 14 and 17 so that the operational voltage thereof is in the range of approximately 8–10 volts.

An optional layer 13 of material which may be dielectric or electrically conducting material is deposited over layer 18 of electron emitting material. Layer 13 may be incorporated, for example, to prevent material in electron emitting layer 18 from leaving the layer, especially when a material such as diamond grit and the like is utilized as the electron emitting material. In some special applications it may also be expedient to utilize an electrically conductive material as layer 13 and even replace conductive layer 17 with layer 13.

FIG. 4 also illustrates in simplified form an optional driver, generally designated 16, formed in substrate 11 at some convenient time during the process as, for example, prior to the formation of layers 12 and 14. Driver 16 can include any well known driving device or devices, such as a FET, MOSFET, or bipolar transistor. By incorporating or integrating driver 16 into substrate 11 external connections and circuitry are reduced. Here it should be understood that the formation of some driving devices, such as MOSFETS, may normally require the addition of epitaxial layers and the like to the upper surface of a substrate and all such layers are hereinafter incorporated into the term supporting substrate.

While pixel 10, illustrated in FIG. 4, is illustrated and disclosed as a single pixel, it should be understood that layers 12 and 17 can easily be patterned into rows and columns with a pixel being formed at the juncture or cross-over points of each row and column to form a typical matrix display. In such a matrix display, pixel 10 of FIG. 4 represents a single row and column juncture or cross-over point. It should also be noted that layer 17 may be patterned to attain a more redundant electron emitting perimeter, to attain a more uniform luminosity from pixel 10, or to provide redundancy in the metal trace formed by layer 17. To complete pixel 10, the structure of FIG. 4 is enclosed in a vacuum package, depicted by an encapsulation layer 19, of sufficient size to allow ease of assembly and efficient gettering by any of the well known conventional getters. Here it should be noted that because the electron emitting and light emitting materials are positioned on the same substrate, the size and spacing of the enclosing package is not crucial. Thus, the packaging of a pixel, or of an entire display, is greatly simplified and the final cost is substantially reduced.

Figure 5:
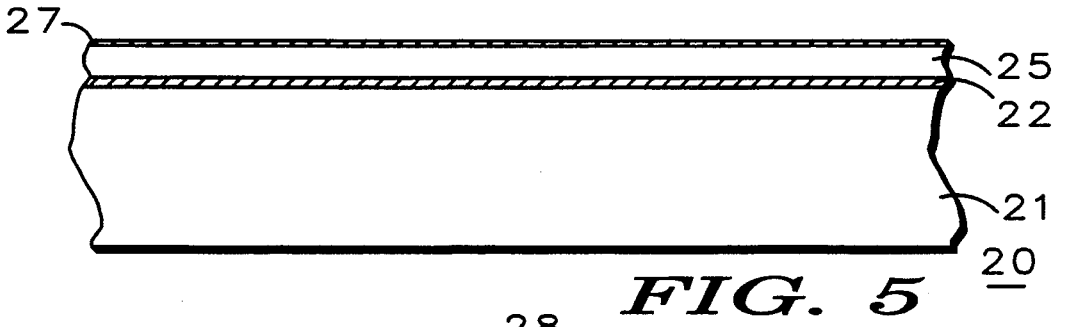
FIGS. 5–9 illustrate various steps in the construction of another embodiment of a vacuum fluorescent pixel in accordance with the present invention.

Various steps in the construction of another embodiment of a vacuum fluorescent pixel 20 in accordance with the present invention are illustrated in FIGS. 5–9. Referring specifically to FIG. 5, a substrate 21 is provided, which is formed of, for example, silicon or saphire. Substrate 21 is provided with a substantially planar upper surface. A layer 22 of conductive material is formed along the upper surface of substrate 21, by some convenient method, such as the deposition of metal by CVD, PECVD, etc. or doping of the substrate. In general. it is believed to be more convenient (and a better conductor) to deposit a layer of metal on the surface of substrate 21, which layer is on the order of 0.5 to 1.0 micrometers thick.

A layer 25 of dielectric material is deposited on the upper surface of layer 22 so as to be substantially coextensive therewith. A layer 27 of conductive material, such as metal, is deposited on the upper surface of layer 25. Layers 22 and 27 are generally, for convenience, formed utilizing a similar process and are generally a similar metal with similar thicknesses.

A layer 28 of an electron emitting low work function material is deposited on layer 27. Layer 28 includes any material that easily emits electrons with a relatively low bias voltage, such as diamond, various metals such as aluminum or gallium with cesium or cesium and oxygen activated surfaces, etc. Diamond is preferred for layer 28 because of the tendency for most other materials to deteriorate with use. Layer 28 may include diamond grit, CVD diamond, a diamond film (see U.S. Pat. No.

5,128,006, entitled "Deposition of Diamond films on Semiconductor Substrates", issued Jul. 7, 1992, for an example of diamond films.) other deposited diamond, a metal based field emission structure, or other suitable electron source.

Figure 6:
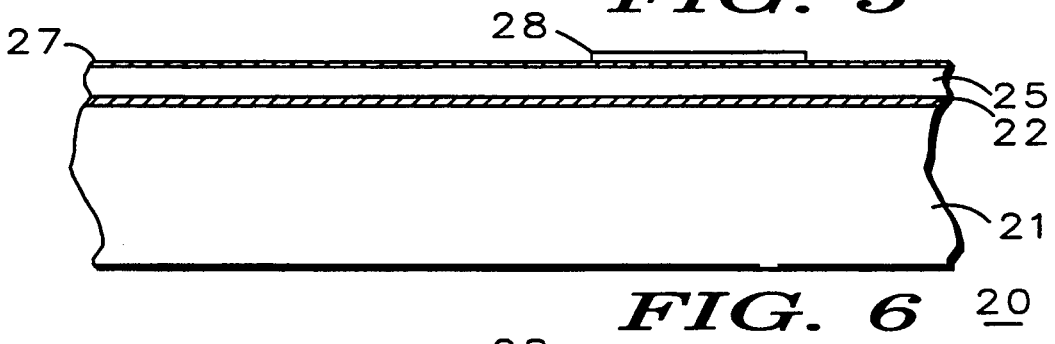
Figure 7:
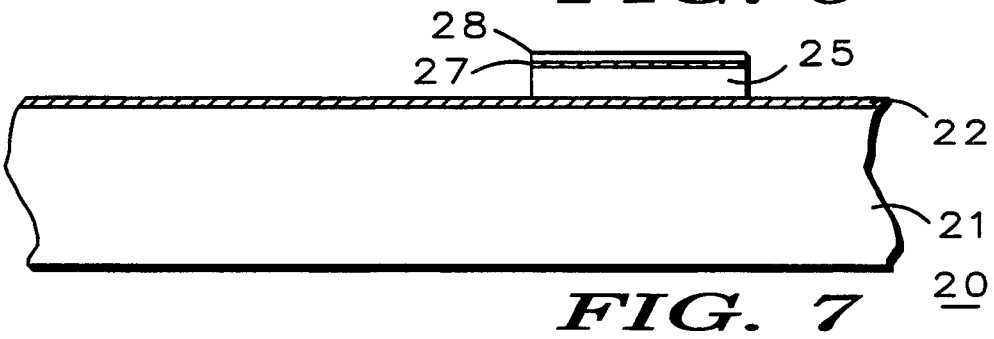
Figure 8:
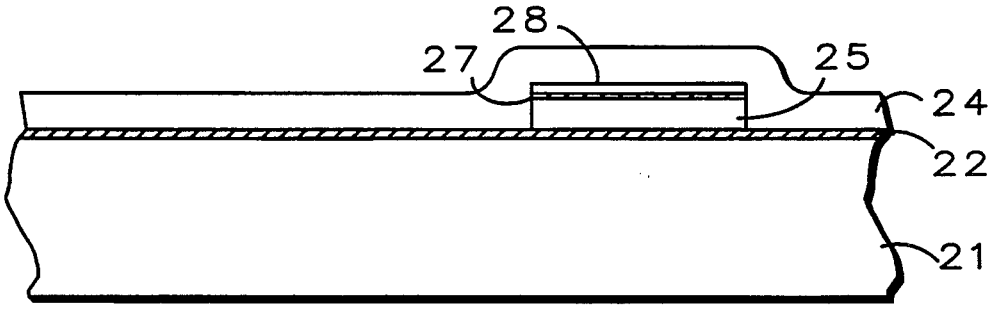
Figure 9:
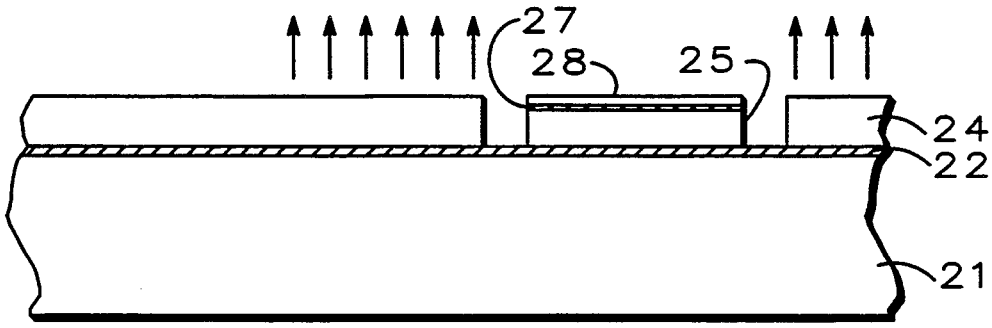

Layer 28 is patterned to be positioned generally on a centrally located portion of pixel 20, as illustrated in FIG. 6. Layer 28 is then utilized as a mask and layers 27 and 25 are etched to uncover conductive layer 22, as illustrated in FIG. 7. A layer 24 of light emitting material including phosphor is positioned on the entire structure of pixel 20 and especially so as to overlie layer 22. Layer 24 may include any of the well known light emitting materials, including the commonly available material ZnO:Zn. In this embodiment layer 24 is approximately one micrometer thick and covers the extent of pixel 20, for convenience in deposition. Layer 24 is then patterned and etched to separate layers 24 and 28, generally as illustrated in FIG. 9. Here it can be seen that layer 28 is substantially centrally located with respect to layer 24 and pixel 20. Again, because the majority of electrons are emitted from the edges of layer 28 and are emitted generally horizontally outwardly, layer 24 is deposited in a position to receive these emitted electrons, or in a generally outwardly extending relationship to layer 28.

While pixel 20, illustrated in FIG. 9, is illustrated and disclosed as a single pixel, it should be understood that layers 22 and 27 can easily be patterned into rows and columns with a pixel being formed at the juncture or cross-over points of each row and column to form a typical matrix display. In such a matrix display, pixel 20 of FIG. 9 represents a single row and column juncture or cross-over point. It should also be noted that layer 27 may be patterned to attain a more redundant electron emitting perimeter, to attain a more uniform luminosity from pixel 20, or to provide redundancy in the metal trace formed by layer 27. To complete pixel 20, the structure of FIG. 9 is enclosed in a package of sufficient size to allow ease of assembly and efficient gettering by any of the well known conventional getters. Here it should be noted that because the electron emitting and light emitting materials are positioned on the same substrate, the size and spacing of the enclosing vacuum package is not crucial. Thus, the packaging of a pixel, or of an entire display, is greatly simplified and the final cost is substantially reduced.

The process disclosed in conjunction with pixel 20 (FIGS. 5–9) is more complex and, therefore, more costly than the process disclosed in conjunction with pixel 10 (FIGS. 1–4). Thus it is preferable to utilize the process disclosed to form pixel 10 and restrict processing temperatures subsequent to the deposition of layer 14 to temperatures that do not degrade the phosphors or cause blistering of overlying materials due to outgassing from the phosphors.

Figure 10:
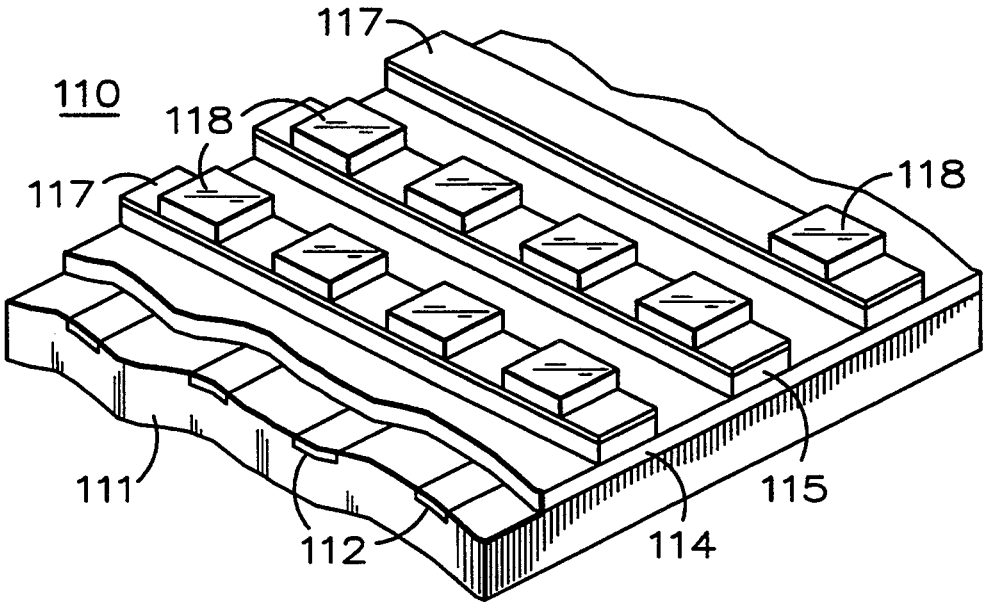
FIG. 10 is a perspective view, portions thereof broken away, illustrating a vacuum fluorescent display in more detail.

In the embodiment of a complete display 110 illustrated in FIG. 10, components similar to those described in FIG. 4 are designated with similar numbers preceded by a 1 to indicate the different embodiment. A Layer of metal 112 is formed, generally by patterned deposition, on an insulating substrate 111 in rows and a layer of metal 117 is formed, generally by patterned deposition, in columns. The crossing points, or junctures of the rows and columns define the positions of a plurality of pixels, with each pixel being similar to the pixel illustrated in FIG. 4. It should be understood that layer 114 of light emitting material may be a continuous layer over the extent of the display or it may be patterned so as to be positioned only at specifically defined pixels. Further, substrate 111 may be constructed of insulating material, may have an insulating layer thereover, or may be junction isolated for row isolation, all of which are encompassed in the term insulating substrate.

Thus, pixels and/or displays are disclosed which use low voltage phosphors and electron impact stimulated light emission without requiring power wasting thermionic filament cathodes. This improvement results in a power saving of greater than 90%, because the power required to actually light the phosphor is less than 10% of the power used to heat the filaments. Thus, the elimination of the need to heat the filament cathodes saves substantial power for this type of display. Also, the elimination of hot filaments allows the thickness of the display to decrease and improves reliability. Further, the pixels and/or displays incorporate single substrate processing, thereby allowing for relatively simple and inexpensive vacuum packaging with conventional getters. That is, the package window is placed sufficiently distant from the device to allow gas conductance to the getter.

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

What is claimed is:

1. A single substrate, vacuum fluorescent display comprising:

a supporting substrate;

a first layer of electrically conductive material positioned on the substrate;

a light emitting layer including phosphor positioned on the first layer;

a layer of dielectric material selectively positioned on the light emitting layer and a second layer of electrically conductive material positioned on the layer of dielectric material, the second layer of electrically conductive material being electrically insulated from the first layer of electrically conductive material; and an electron emitting layer of low work function material positioned on the second layer of electrically conductive material, the layer of dielectric material, the second layer of electrically conductive material and the electron emitting layer being patterned so as to be positioned on a centrally located portion of the light emitting layer with portions of the light emitting layer extending outwardly therefrom and substantially surrounding the electron emitting layer, and the electron emitting layer being further positioned so that emitted electrons strike the portions of the light emitting layer extending outwardly from the dielectric layer.

2. A single substrate, vacuum fluorescent display as claimed in claim 1 wherein the first and second layers of electrically conductive material are patterned into rows and columns, respectively, to form a matrix.

3. A single substrate, vacuum fluorescent display as claimed in claim 2 wherein the supporting substrate is an insulating substrate.

4. A single substrate, vacuum fluorescent display as claimed in claim 3 wherein the layer of dielectric material, the second layer of electrically conductive material and the electron emitting layer are patterned to form a pixel at each juncture of the rows and columns.

5. A single substrate, vacuum fluorescent display as claimed in claim 3 wherein the light emitting layer is patterned to form a pixel at each juncture of the rows and columns.

6. A single substrate, vacuum fluorescent display as claimed in claim 3 wherein the first and second layers of electrically conductive material include metal patterned to form strips of conductive metal positioned in rows and columns.

7. A single substrate, vacuum fluorescent display as claimed in claim 1 wherein the light emitting layer includes ZnO:Zn.

8. A single substrate, vacuum fluorescent display as claimed in claim 1 wherein the electron emitting layer includes diamond grit.

9. A single substrate, vacuum fluorescent display as claimed in claim 1 wherein the electron emitting layer includes a diamond film.

10. A single substrate, vacuum fluorescent display as claimed in claim 1 including in addition an encapsulation layer spaced from and encapsulating the electron emitting layer.

11. A single substrate, vacuum fluorescent display as claimed in claim 1 including in addition integrated driver circuitry formed in the supporting substrate and electrically coupled to at least one of the first and second layers of electrically conductive material.

12. A single substrate, vacuum fluorescent display comprising:

a supporting substrate;

a first layer of electrically conductive material positioned on the substrate:

a light emitting layer including phosphor positioned on the first layer;

a substantially centrally located opening defined through the light emitting layer with portions of the light emitting layer substantially surrounding the centrally located opening;

a layer of dielectric material positioned in the centrally located opening of the light emitting layer;

a second layer of electrically conductive material positioned on the dielectric layer, the second layer of electrically conductive material being electrically insulated from the first layer of electrically conductive material; and an electron emitting layer of low work function material positioned on the second layer of electrically conductive material and further positioned so that emitted electrons strike the portions of the light emitting layer extending outwardly from the dielectric layer.

13. A single substrate, vacuum fluorescent display comprising:

a supporting substrate;

rows of metal positioned on the substrate;

light emitting material including phosphor positioned on the rows of metal so as to define a plurality of pixels;

a layer of dielectric material positioned on a centrally located portion of each of the pixels with portions of light emitting material at each pixel extending outwardly therefrom;

columns of metal positioned on the dielectric layers so as to define junctures with the rows of metal at each pixel; and an electron emitting layer of low work function material positioned on the columns of metal at each pixel and further positioned so that electrons emitted by the emitting layer at each pixel strike the outwardly extending portions of light emitting material adjacent thereto.

14. A single substrate, vacuum fluorescent display as claimed in claim 13 wherein each pixel of light emitting material includes a centrally located opening therethrough and the layer of dielectric material positioned on the centrally located portion of each pixel is located within the opening.

15. A single substrate, vacuum fluorescent display as claimed in claim 13 wherein the electron emitting layer of low work function material includes diamond.

16. A single substrate, vacuum fluorescent display as claimed in claim 15 wherein the electron emitting layer of low work function material including diamond is in the form of a diamond grit.

17. A single substrate, vacuum fluorescent display as claimed in claim 15 wherein the electron emitting layer of low work function material including diamond is in the form of a diamond film.

18. A single substrate, vacuum fluorescent display as claimed in claim 13 including in addition integrated driver circuitry formed in the supporting substrate and electrically coupled to at least one of the first and second layers of electrically conductive material.

* * * * *